US009014607B2

(12) United States Patent
Watanabe

(10) Patent No.: US 9,014,607 B2
(45) Date of Patent: Apr. 21, 2015

(54) IMAGE FORMING APPARATUS

(75) Inventor: Masahiro Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 348 days.

(21) Appl. No.: 13/045,727

(22) Filed: Mar. 11, 2011

(65) Prior Publication Data

US 2011/0222923 A1 Sep. 15, 2011

(30) Foreign Application Priority Data

Mar. 12, 2010 (JP) ..... 2010-056810

(51) Int. Cl.
*G03G 15/20* (2006.01)

(52) U.S. Cl.
CPC .... *G03G 15/2075* (2013.01); *G03G 2215/2032* (2013.01); *G03G 2215/2093* (2013.01)

(58) Field of Classification Search
CPC ..... G03G 15/20
USPC ..... 399/123, 34, 71, 129, 320, 326, 327, 399/329
See application file for complete search history.

(56) References Cited

U.S. PATENT DOCUMENTS

| | | | | |
|---|---|---|---|---|
| 6,792,236 | B2 * | 9/2004 | Yoda et al. | 399/325 |
| 7,113,717 | B2 * | 9/2006 | Bott et al. | 399/67 |
| 7,483,663 | B2 * | 1/2009 | Ide et al. | 399/327 |
| 7,630,675 | B2 * | 12/2009 | Tateishi et al. | 399/327 |
| 2010/0232846 | A1 | 9/2010 | Watanabe | |
| 2010/0316421 | A1 * | 12/2010 | Komuro | 399/329 |

FOREIGN PATENT DOCUMENTS

| | | | |
|---|---|---|---|
| JP | 61-23183 | A | 1/1986 |
| JP | 8-152801 | | 6/1996 |
| JP | 9-292791 | | 11/1997 |
| JP | 10-288908 | A | 10/1998 |
| JP | 2000-98790 | | 4/2000 |
| JP | 2001-42683 | | 2/2001 |
| JP | 2001-215838 | | 8/2001 |
| JP | 2001-272875 | | 10/2001 |
| JP | 2002-189374 | | 7/2002 |
| JP | 2003-295667 | | 10/2003 |
| JP | 2007-328161 | A | 12/2007 |
| JP | 2008-1544 | | 1/2008 |
| JP | 2008-225183 | | 9/2008 |
| JP | 2009-25519 | | 2/2009 |

OTHER PUBLICATIONS

Office Action issued on Oct. 10, 2013, in Japanese patent Application No. 2010-056810.

* cited by examiner

*Primary Examiner* — Benjamin Schmitt
*Assistant Examiner* — Matthew Miller
(74) *Attorney, Agent, or Firm* — Oblon, McClelland, Maier & Neustadt, L.L.P.

(57) ABSTRACT

A heating device includes a fixing member; a pressure member that comes in pressure contact with a surface of the fixing member; and a cleaning web unit. The cleaning web unit includes a contact roller that contacts the pressure member via a web that is impregnated with a lubricant agent, a supplying roller that supplies a new web, a roll-up roller that rolls up and retrieves the web that has been used for wiping off adhering matter from the pressure member, and a lubricant agent absorption member that absorbs the lubricant agent by contacting the web at a web path extending from the supplying roller to the contact roller.

14 Claims, 7 Drawing Sheets

IMAGE FORMING APPARATUS

BACKGROUND OF THE INVENTION

1. Field of the Invention

The present invention relates to electrophotographic image forming apparatuses such as copiers, printers, facsimile machines, and multifunction peripherals having functions of the aforementioned devices.

2. Description of the Related Art

In fixing devices that use heat and pressure, a pressure member is pressed against a fixing member having a heat source provided inside. A transfer sheet with an unfixed toner image is passed through the part between the fixing member and the pressure member, to fix the toner onto the transfer sheet (a recording medium).

The surface of the fixing member is covered by, for example, fluorine coating, to prevent toner from adhering to the fixing member. However, depending on various conditions relevant to the environment or the recording medium, a slight amount of toner on the recording medium may adhere to the fixing member, which is referred to as offset. The offset toner remains on the fixing member and the pressure member that contacts the fixing member. This toner may transfer to the recording medium and soil the image on the recording medium. To prevent such a situation, the fixing member is provided with a cleaning member such as a cleaning web or a cleaning roller.

The cleaning member is pressed against the fixing member and the pressure member to collect the offset toner. To collect the offset toner, particularly, in a reliable manner, a cleaning web involving a roll-up operation is used for appropriately collecting the toner, with which high cleaning performance can be constantly achieved.

A cleaning web is typically impregnated with a small amount of silicone oil (for example, 5 $g/m^2$ through 10 $g/m^2$) for the purpose of achieving high cleaning performance. However, when the oil is unevenly applied, the resultant image may have uneven gloss.

Furthermore, when the cleaning web is brought in contact with the pressure roller, the oil that is unevenly applied on the pressure roller may be transferred to the fixing belt or the fixing roller. In this case, because the cleaning web is disposed at the pressure roller, the fixing belt or fixing roller does not contact the cleaning web. Therefore, the unevenness on the fixing belt or fixing roller cannot be evened out by contacting the cleaning web immediately after performing a fixing operation of one sheet. Accordingly, the resultant image may have a significant level of uneven gloss. A supplying roller stores the cleaning web in a rolled-up state. The amount of impregnated silicone oil increases toward the center of the diameter of the rolled-up cleaning web. That is to say, the amount of impregnated silicone oil increases toward the end of the operating life of the cleaning web.

To address this problem, patent documents 1 and 2 disclose mechanisms for separating the web contact roller from the contact object while the machine is in a standby state, so that excessive oil is prevented from exuding during the standby state. However, a link mechanism or an actuator mechanism is required for the separating motion, which requires high cost. Furthermore, when there is excessive silicone oil while the machine is operating, effects of this mechanism cannot be expected to be achieved. Patent document 3 discloses a method of providing a cleaning web including silicone oil and a cleaning web that does not include silicone oil. The cleaning webs are brought into contact or separated from the object according to fixing conditions, so that unevenness in gloss caused by silicone oil is eliminated. However, this method requires complex control operations, and requires high cost, as apparent from the configuration. Furthermore, in cases where the cleaning web including silicone oil needs to be used for achieving high cleaning performance, effects of this method cannot be expected to be achieved.

Among the above-described fixing devices, some devices have a function of moving the pressure member with respect to the fixing member for applying pressure, reducing pressure, and not applying pressure (by separating the pressure member from the fixing member). This function is used for the purpose of preventing the degradation of the fixing member and the pressure member. Specifically, the members are separated when the device is not used so that load is not applied to the members. Furthermore, the members may be separated for the purpose of cooling only the pressure member. Furthermore, some devices have a function of implementing plural positional relationships between the pressure member and the fixing member when the pressure member is pressed against the fixing member, such as strong press-contact and weak press-contact. This function is used for the purpose of achieving the optimum press-contact state according to the environment and conditions of the recording medium.

In a configuration where the cleaning member (contact roller) is brought into contact with a movable pressure member as described above, when the length between the contact roller and the pressure member increases and the cleaning web is not sufficiently pressed against the pressure member, the cleaning function cannot be sufficiently implemented and consequently the image is soiled. Furthermore, when the length between the contact roller and the pressure member decreases and the cleaning web is excessively pressed against the pressure member, the materials forming the contact roller and the pressure member are degraded, and the torque required for rolling up the cleaning web increases, and the cleaning web may not be properly retrieved.

That is to say, when the positional change of the pressure member is sufficiently small at the location where the cleaning member contacts the pressure member, the cleaning member can be completely fixed with respect to the fixing device. However, when the pressure member is configured to separate from such a location, the positional change of the pressure member is large. Thus, the toner cleaned off from the pressure member may fly out, transfer to the recording medium, and cause failures.

Furthermore, there may be cases where a large amount of toner enters the cleaning nip part where the cleaning web is pressed against a member that is the object of cleaning (cleaning object), due to factors such as a fixing failure occurring while the fixing device is operating or a paper jam occurring at the fixing nip. In such a case, a large amount of melted or half-melted toner is expected to accumulate at the cleaning nip. When a large amount of melted or half-melted toner is accumulated at the cleaning nip, and the fixing device stops operating and is left to cool down until the toner is fixed on the cleaning web and the cleaning object, the following problem may arise. That is, when the fixing device starts operating once again, the cleaning web may be unexpectedly discharged from the roll-up roller (that rolls up the used web to retrieve the used web) and the supplying roller (that supplies a new web).

When the web is unexpectedly discharged, the web may sag and tangle with surrounding components, thus causing various operational failures. For example, when the cleaning object is a pressure roller, the web may be wound around the pressure roller. In another example, the web may tangle with a separation mechanism for separating the recording medium with fixed toner from the fixing member. As a result, the separation mechanism may not be able to separate the recording medium from the fixing member. Furthermore, when the web is rolled out from the roll-up roller and the web sags, a web that is soiled from being used for a cleaning operation may be used once again for cleaning. Accordingly, a cleaning failure is caused, which leads to abnormal images.

To prevent the web from being discharged as described above, there are means for preventing reversal, such as providing the roll-up roller with a one-way clutch mechanism, or using a worm gear as the roll-up roller driving system. However, as the roll-up roller retrieves the used web, the diameter of the rolled-up cleaning web increases. Therefore, the torque required for retrieving the web continuously increases assuming that the web is pulled with a constant force at the cleaning nip part. Under such circumstances, when a large amount of unfixed toner enters the cleaning nip as described above, and conditions by which toner is fixed are fulfilled, excessive load is disadvantageously applied on the means for preventing reversal. Furthermore, even if the means for preventing reversal can withstand the torque, if the used web is loosely rolled-up by the roll-up roller, the web that is loosely rolled-up may be discharged in the direction opposite to the web roll-up direction under the conditions in which toner is fixed. Consequently, the used web may enter the cleaning nip part once again.

A method of adding some means for preventing reverse rotation to the shaft of the roll-up roller (see, for example, patent document 4) is typically known as a means for preventing reversal. This method is for adding a reversal torque to the roll-up roller shaft, and therefore as the diameter of the roll-up roller increases, the required torque increases.

Patent Document 1: Japanese Laid-Open Patent Publication No. 2001-215838

Patent Document 2: Japanese Laid-Open Patent Publication No. H08-152801

Patent Document 3: Japanese Laid-Open Patent Publication No. 2009-025519

Patent Document 4: Japanese Laid-Open Patent Publication No. 2008-01544

SUMMARY OF THE INVENTION

The present invention provides a heating device, a fixing device, and an image forming apparatus in which one or more of the above-described disadvantages are eliminated.

A preferred embodiment of the present invention provides a heating device, a fixing device, and an image forming apparatus, in which excessive silicone oil impregnated in a cleaning web is collected before guiding the cleaning web to the cleaning nip.

According to an aspect of the present invention, there is provided a heating device including a fixing member; a pressure member that comes in pressure contact with a surface of the fixing member; and a cleaning web unit including a contact roller that contacts the pressure member via a web that is impregnated with a lubricant agent, a supplying roller that supplies a new web, a roll-up roller that rolls up and retrieves the web that has been used for wiping off adhering matter from the pressure member, and a lubricant agent absorption member that absorbs the lubricant agent by contacting the web at a web path extending from the supplying roller to the contact roller.

According to an aspect of the present invention, there is provided a heating device including a fixing belt that is an endless belt wound around plural rollers or sliding members, the fixing belt being caused to move around the plural rollers or sliding members; a pressure member that comes in pressure contact with a surface of the fixing belt, so that a toner layer resting on a recording medium is fixed to the recording medium by heat and pressure when the recording medium passes through a nip part between the fixing belt and the pressure member, the fixing belt having a higher toner releasability than a pressure member; a mechanism that changes a position where the pressure member contacts the fixing belt so that the nip part becomes present or absent and a width of the nip part is adjusted; and a web cleaning unit including a contact roller that contacts the pressure member via a web that is impregnated with a lubricant agent, a supplying roller that supplies a new web, a roll-up roller that rolls up and retrieves the web that has been used for wiping off adhering matter from the pressure member, and a lubricant agent absorption member that absorbs the lubricant agent by contacting the web at a web path extending from the supplying roller to the contact roller.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1A:
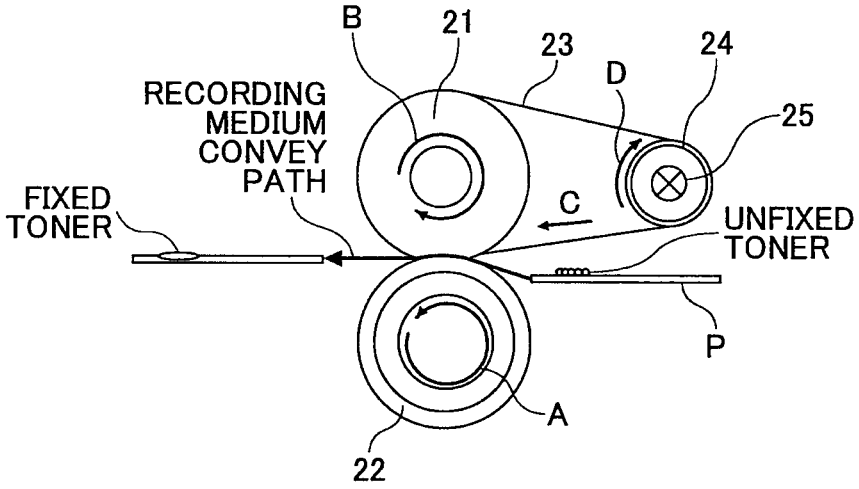
FIG. 1A is a schematic diagram of an example of a basic configuration of a heating device and a fixing device according to an embodiment of the present invention.

In an embodiment of the present invention, excessive silicone oil that is impregnated in a cleaning web is collected before the cleaning web is guided to a cleaning nip. According to an aspect of the present invention, there is provided a heating device including an endless fixing belt as a fixing member wound around plural rollers or sliding members, the fixing belt being caused to move around the plural rollers or sliding members, the fixing belt having a higher toner releasability than a pressure member; the pressure member that comes in pressure contact with a surface of the fixing belt, so that a toner layer resting on a recording medium is fixed to the recording medium by heat and pressure when the recording medium passes through a nip part between the fixing belt and the pressure member; a mechanism that changes a position where the pressure member contacts the fixing belt, by which the nip part becomes present or absent and by which a width of the nip part is adjusted; and a web cleaning unit including at least a contact roller that contacts the pressure member via a web that is impregnated with a lubricant agent, a supplying roller that supplies a new web, a roll-up roller that rolls up and retrieves the web that has been used for wiping off adhering matter from the pressure member, and a lubricant agent absorption member that absorbs the lubricant agent by contacting the web at a web path extending from the supplying roller to the contact roller. That is to say, the silicone oil collecting member is brought in direct contact with the web before the web is guided into the cleaning nip, to collect excessive silicone oil that is impregnated in the web. Accordingly, excessive silicone oil is prevented from being applied onto the surface of the fixing member during the cleaning operation, and uneven gloss and gloss streaks are prevented from being formed on the fixed image. The fixing member is not limited to a belt; the fixing member may be, for example a roller. Furthermore, it is also possible to use any lubricant agent other than silicone oil, which can be used in these types of heating devices and fixing devices.

Furthermore, in an embodiment of the present invention, in order to maintain an oil impregnation amount that does not degrade the cleaning performance and to collect excessive silicone oil during the operating life of the cleaning web unit, the silicone oil absorption member does not contact the web when the web is initially supplied from the supplying roller, but the silicone oil absorption member contacts the web at the web path when a consumption amount of the web reaches a predetermined amount, and continues to contact the web thereafter.

Furthermore, in an embodiment of the present invention, in order to collect excessive silicone oil impregnated in the web and to prevent the silicone oil absorption member from degrading even if it is used near the heating member, the silicone oil absorption member has heat resistance for resisting heat of a temperature greater than or equal to the maximum temperature of the pressure roller with which the web is brought into contact, and the silicone oil absorption member includes a microscopic pore structure provided inside the silicone oil absorption member.

Furthermore, in an embodiment of the present invention, a mechanism for collecting excessive silicone oil can be provided even if the cleaning web unit operates in accordance with the pressure application operation and pressure reduction operation, and in order to maintain good cleaning properties, the position of the cleaning web unit is changed in accordance with the pressure application operation and the pressure reduction operation.

A description is given, with reference to the accompanying drawings, of embodiments of the present invention.

Figure 7:
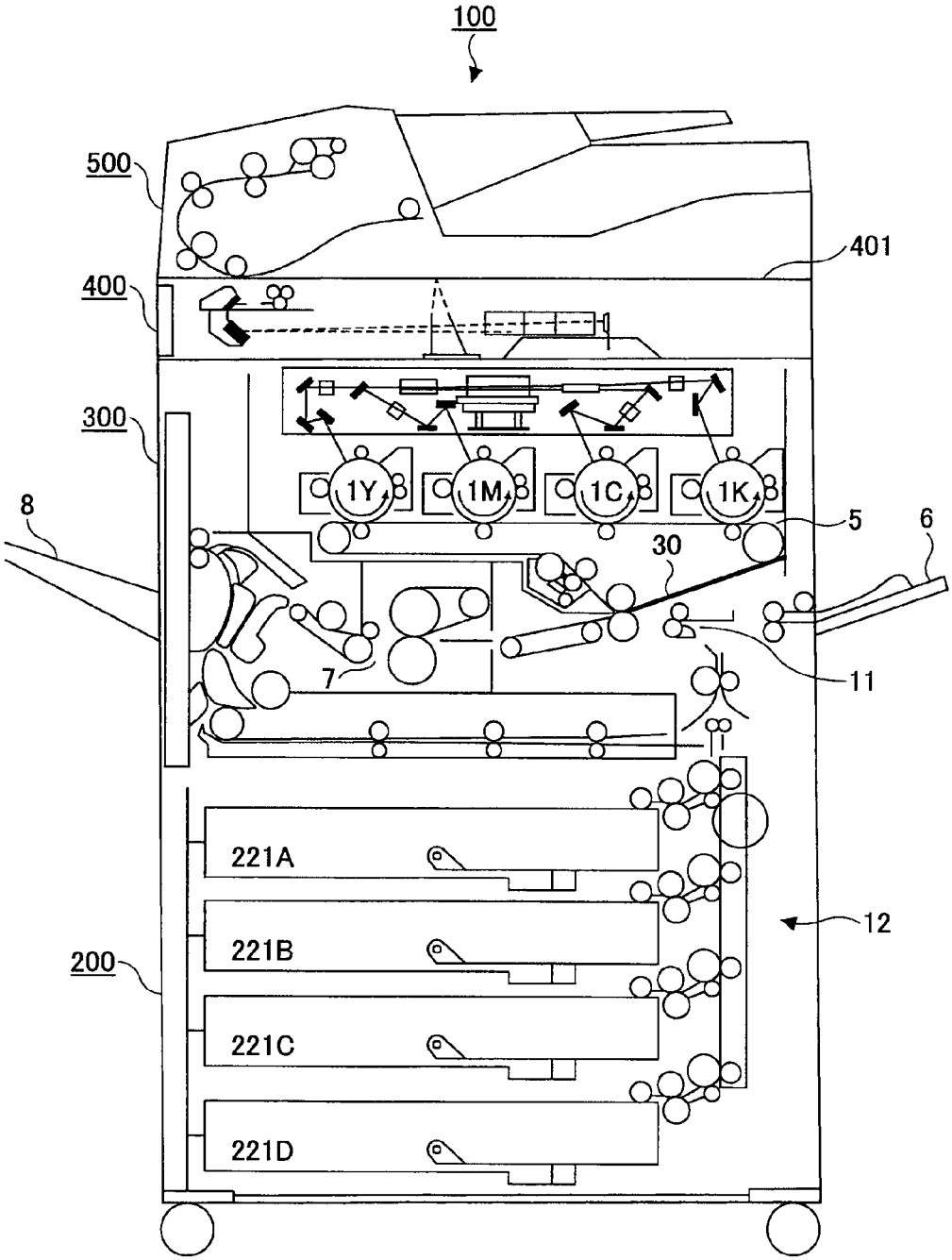
FIG. 7 is a vertical cross-sectional front view schematically illustrating a full-color image forming apparatus according to an embodiment of the present invention.

FIG. 7 is a vertical cross-sectional front view schematically illustrating a full-color image forming apparatus according to an embodiment of the present invention. An image forming apparatus 100 according to the present embodiment is a tandem-type (juxtaposed type) electrophotographic full-color image forming apparatus including an image forming unit (printer engine) 300 acting as an image forming means in the middle of the apparatus main body, and a sheet feeding unit 200 acting as a sheet feeding device provided immediately below the image forming unit (printer engine) 300. The sheet feeding unit 200 is provided with four stages of sheet feeding cassettes 221A through 221D acting as sheet storing units. The sheet feeding cassettes 221A through 221D can be freely pulled out from and pushed into (back and forth) the apparatus main body of the image forming apparatus 100 (i.e., in directions toward the front of the page and toward the back of the page on which FIG. 1 is illustrated). Furthermore, a scanning unit (scanner) 400 for scanning an original image is provided above the printer engine 300. Furthermore, a sheet eject tray 8 to which sheets with images are ejected, is provided on the downstream side of the printer engine 300 in the sheet conveying direction (left side as viewed in FIG. 1). Furthermore, a bypass tray (manual feed tray) 6 that is a sheet storing unit used for manually feeding sheets, is provided on the upstream side of the printer engine 300 in the sheet conveying direction (right side as viewed in FIG. 1).

The printer engine 300 includes four image forming units for yellow (Y), cyan (C), magenta (M), and black (K) configuring a sheet transfer unit 5, which are disposed in parallel above an intermediate transfer belt 30 that is an endless belt. The image forming units include electrophotographic processing members or units such as a charging unit, an optical writing unit, a developing unit, and a cleaning unit, which are arranged along the outer periphery of drum-type photoconductors 1Y, 1C, 1M, and 1K provided for the respective colors.

Although not illustrated in detail, the charging unit performs a charging process on the surface of the photoconductor 1Y, 1C, 1M, 1K, and the optical writing unit writes image information onto the surface of the photoconductor 1Y, 1C, 1M, 1K by radiating laser beams. An electrostatic latent image is formed on the surface of the photoconductor 1Y, 1C, 1M, 1K by an exposure process. The developing unit develops the electrostatic latent image that has been formed on the photoconductor 1Y, 1C, 1M, 1K into a visible toner image. A cleaning unit is used to remove/collect toner remaining on the surface of the photoconductor 1Y, 1C, 1M, 1K, after the toner image is transferred from the photoconductor 1Y, 1C, 1M, 1K to the intermediate transfer belt 30. Color images of the respective colors Y, C, M, and K, are sequentially formed on the intermediate transfer belt 30, so that four color images are superposed on one another to form a single four-color image. Specifically, first, a Y image forming unit develops a Y toner image, and transfers the Y toner image onto the intermediate transfer belt 30. Next, a C image forming unit develops a C toner image, and transfers the C toner image onto the intermediate transfer belt 30. Next, an M image forming unit develops an M toner image, and transfers the M toner image onto the intermediate transfer belt 30. Lastly, a K image forming unit develops a K toner image, and transfers the K toner image onto the intermediate transfer belt 30. Then, the four-color image is transferred, by a sheet transfer unit 5, onto a transfer sheet that is fed from the sheet feeding unit 200. The image is fixed onto the transfer sheet by a fixing device 7. The sheet is ejected to the sheet eject tray 8 by a sheet eject roller. Meanwhile, after the full-color toner image has been transferred from the intermediate transfer belt 30 to the transfer sheet, the toner remaining on the surface of the intermediate transfer belt 30 is removed and collected by a belt cleaning unit.

The sheet feeding unit 200 includes the four stages of sheet feeding cassettes 221A through 221D described above, in which transfer sheets set by a user are stacked and held. The sheet sizes and sheet types set in the respective sheet feeding cassettes 221A through 221D may be determined by the user. Furthermore, there may be a means for determining the sheet size, the sheet type, or the sheet thickness according to a device for measuring the positions of the side guides aligning the transfer sheets and for measuring the resistance of stacked sheets in the sheet feeding cassettes 221A through 221D, and automatically setting the determined results as the conditions of the sheet feeding cassettes 221A through 221D. The sheet feeding cassettes 221A through 221D, the bypass tray 6, and resist rollers 11 are connected by a conveying path 12. A transfer sheet fed from any sheet feeding location is transferred to the resist rollers 11 via the conveying path 12. The transfer sheet is temporarily stopped at the resist rollers 11. The sheet is then sent into the sheet transfer part at a timing to attain a predetermined positional relationship between the toner image on the intermediate transfer belt 30 and the leading edge of the transfer sheet. The resist rollers 11 function in the same manner with respect to a transfer sheet conveyed from the bypass tray 6.

Although not illustrated in detail, the scanner 400 includes plural moving bodies provided with a light source for radiating light to original documents, and mirrors. The moving bodies move back and forth to scan an original document placed on a contact glass 401. Image information obtained by the scanning process of the moving bodies is focused by lenses onto an imaging surface of a CCD provided at the back. The image information is read as image signals by the CCD. The image signals are then converted into digital signals and are subjected to image processing. Then, based on the signals that have been subjected to image processing, optical writing is performed on the surface of the photoconductor with light emitted from a laser diode LD in an optical writing unit, to form an electrostatic latent image. The light signals from the LD reach the photoconductor via a polygon mirror and lenses. On top of the scanner 400, there is provided an automatic document feeder 500 for automatically conveying an original document onto the contact glass 401.

First Embodiment

FIG. 1A is a schematic diagram of an example of a basic configuration of a heating device and a fixing device according to an embodiment of the present invention. The fixing device illustrated in FIG. 1A includes a fixing belt 23 that is an example of an endless belt. The fixing belt 23 is wound around two rollers, a fixing roller 21 and a heating roller 24. The endless belt may be wound around three or more rollers or sliding members. A pressure roller 22 that is an example of a pressure member is pressed against the surface of the fixing belt 23. In the example of FIG. 1A, the pressure roller 22 is pressed against the part of a fixing belt wound around the fixing roller 21.

The pressure roller 22 is rotated by a motor (not shown) in a direction indicated by an arrow A in FIG. 1A. The rotation of the pressure roller 22 is transmitted to the fixing roller 21 via a gear (not shown), and the fixing roller 21 is rotated in a direction indicated by an arrow B in FIG. 1A. According to the rotation of the fixing roller 21, the fixing belt 23 circulates in a direction indicated by an arrow C in FIG. 1A. According to the circulation of the fixing belt 23, the heating roller 24 is rotated in a direction indicated by an arrow D in FIG. 1A.

As described above, the fixing device according to the present embodiment includes an endless belt that circulates and that is wound around plural rollers. In the example shown in FIG. 1A, the endless belt is the fixing belt 23 that is wound around at least two rollers, i.e., the fixing roller 21 and the heating roller 24. A pressure member that is the pressure roller 22 is pressed against the surface of the fixing belt 23. The pressure member may be a pressure belt. The heating roller 24 is formed in midair. A heater 25 is provided inside the heating roller 24. The heater 25 heats both the heating roller 24 and the fixing belt 23. The pressure roller 22 and the fixing roller 21 may be used as midair shafts, and heaters may be additionally provided inside the pressure roller 22 and the fixing roller 21 to heat the respective rollers. The part of the fixing belt 23 in contact with the heating roller 24, the part of the fixing belt 23 in contact with the fixing roller 21, and the pressure roller 22 respectively include temperature sensors (not shown) facing each other. Based on the temperature detection results of the respective sensors, the power supply to the heaters are controlled, so that the temperature of the fixing belt 23 and the pressure roller 22 is controlled to be an appropriate temperature for fixing the toner layer. The fixing belt 23 includes a base material made of polyimide, silicone rubber provided on the base material, and a top layer made of fluorine resin laminated on the surface of the silicone rubber.

Figure 1B:
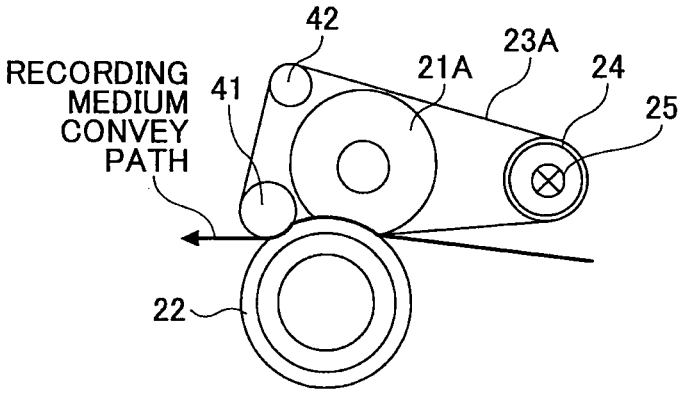
FIG. 1B illustrates a modification of the example shown in FIG. 1A.

FIG. 1B illustrates a fixing device according to a modification of the present embodiment. The fixing device shown in FIG. 1B includes a separation roller 41, a tension roller 42, a fixing roller 21A, the heating roller 24, and a fixing belt 23A that is an example of an endless belt wound around the aforementioned rollers.

Figure 1C:
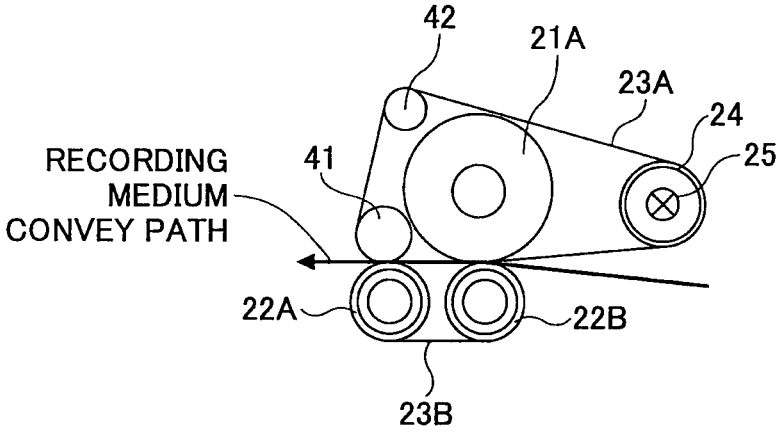
FIG. 1C illustrates another modification of the example shown in FIG. 1A.

FIG. 1C illustrates a fixing device according to another modification of the present embodiment. In the fixing device shown in FIG. 1C, a pressure member includes two pressure members, i.e., pressure rollers 22A and 22B, and an endless belt 23B wound around the pressure rollers 22A and 22B.

Figure 1D:
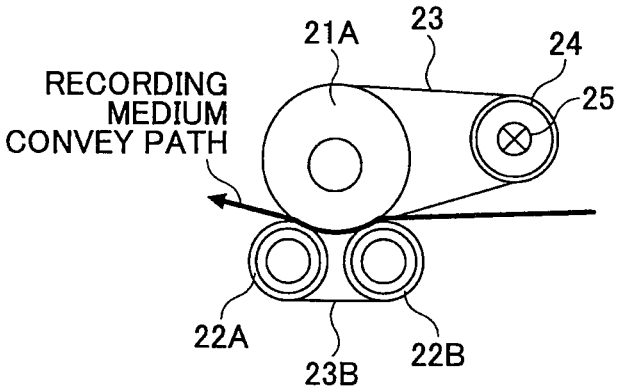
FIG. 1D illustrates yet another modification of the example shown in FIG. 1A.

FIG. 1D illustrates a fixing device according to yet another modification of the present embodiment. The fixing device shown in FIG. 1D includes a fixing member including the fixing belt 23 wound around the fixing roller 21A and the heating roller 24, and the pressure member shown in FIG. 1C.

In the above embodiment and modifications, nips are formed by rollers. However, some or all of the rollers may be replaced by sliding members to form nips.

Figure 2:
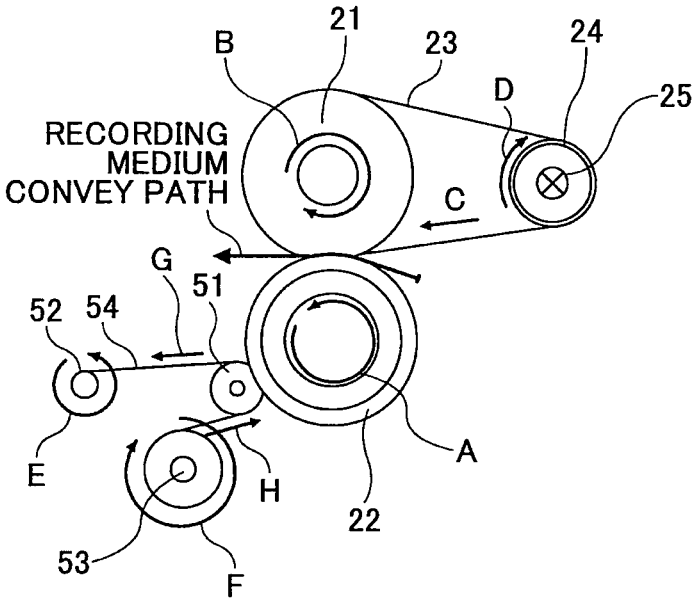
FIG. 2 is a schematic diagram of a fixing device according to a first embodiment of the present invention.

FIG. 2 is a schematic diagram of a fixing device according to a first embodiment of the present invention. In the present embodiment, a cleaning web unit includes at least a cleaning web contact roller 51, a cleaning web roll-up roller 52, a cleaning web supply roller 53, a cleaning web 54, and a driving unit for driving the cleaning web roll-up roller 52. The cleaning web unit is disposed facing the pressure roller 22, and the cleaning web 54 is caused to contact the pressure roller 22 by the cleaning web contact roller 51, to wipe off the toner soiling remaining on the pressure roller 22.

After the cleaning web 54 is used for wiping off the toner, the cleaning web 54 is rolled up by the cleaning web roll-up roller 52 that is rotated by a driving unit (not shown) in a direction indicated by an arrow E in FIG. 2, so that the cleaning web 54 is retrieved in a direction indicated by an arrow G in FIG. 2. Furthermore, as the cleaning web supply roller 53 is rotated in a direction indicated by an arrow F in FIG. 2, a new cleaning web 54 is rolled out in a direction indicated by an arrow H in FIG. 2, and is supplied at a contact part between the cleaning web contact roller 51 and the pressure roller 22. For example, the fixing members and pressure members described with reference to FIGS. 1B through 1D may be applied to the fixing device illustrated in FIG. 2.

Figure 3:
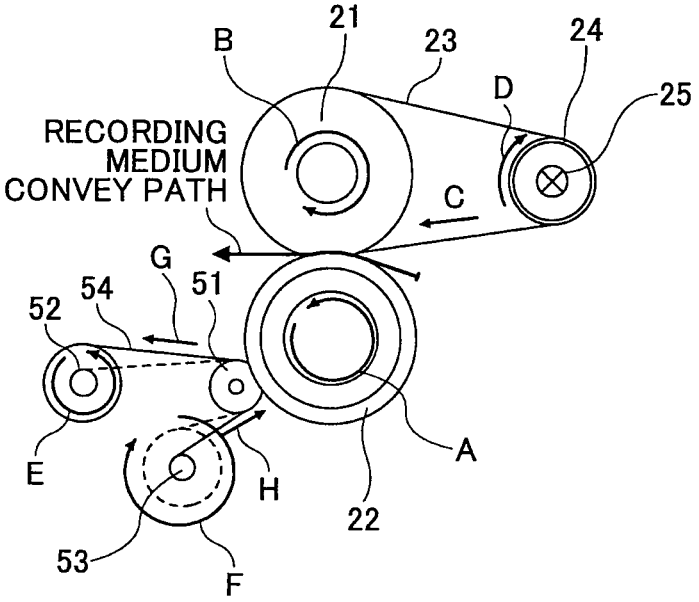
FIG. 3 illustrates the transition from an initial state of the cleaning web shown in FIG. 2 to a state where the cleaning web is used.

FIG. 3 illustrates the transition from an initial state of the cleaning web shown in FIG. 2 to a state where the cleaning web is used. As the cleaning web is used, the used cleaning web 54 is rolled-up by the cleaning web roll-up roller 52, and the diameter of the cleaning web roll-up roller 52 increases. Accordingly, the rolled up cleaning web 54 moves along a path that changes according to an increase in the diameter of the cleaning web roll-up roller 52.

Second Embodiment

Figure 4A:
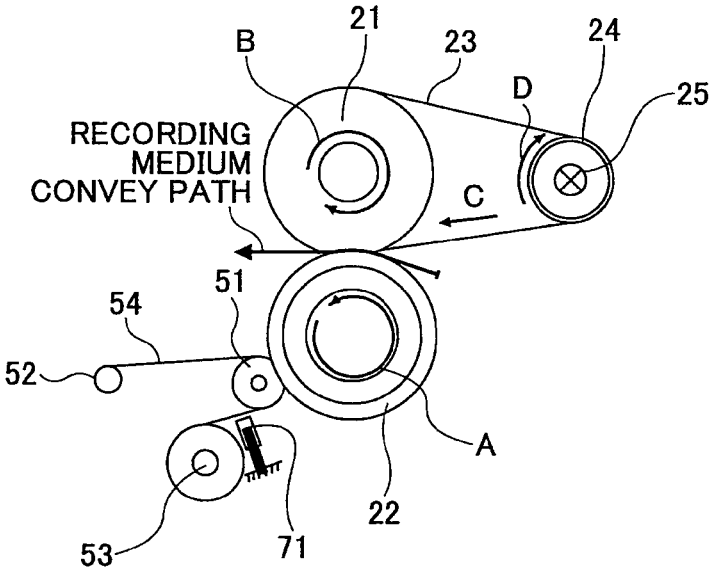
FIG. 4A illustrates a fixing device according to a second embodiment of the present invention.
Figure 4B:
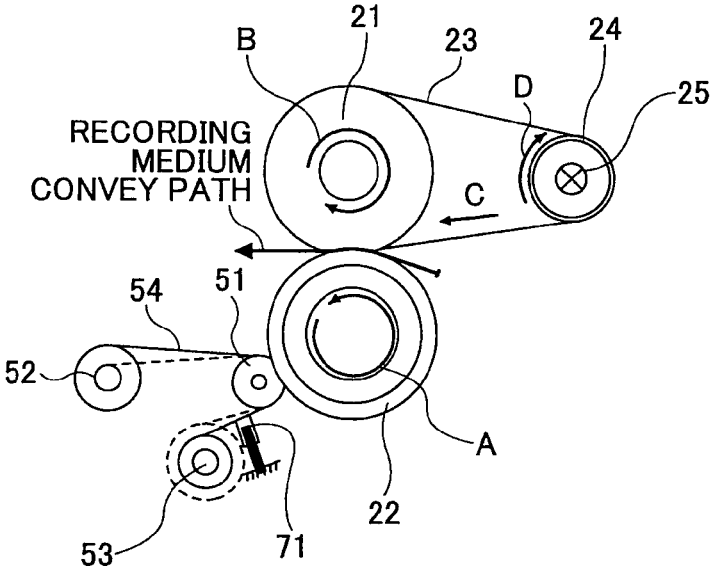
FIG. 4B illustrates the fixing device according to the second embodiment of the present invention after operating for a period of time.
Figure 4C:
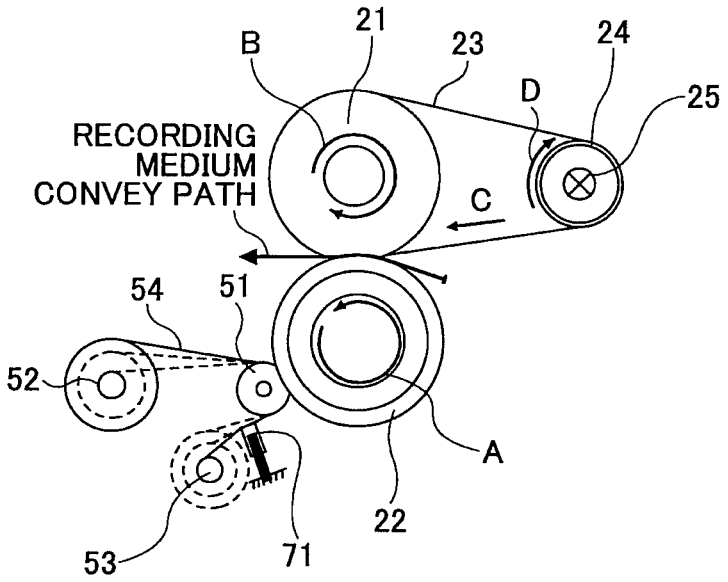
FIG. 4C illustrates the fixing device according to the second embodiment of the present invention when the operating life has ended.

FIGS. 4A through 4C illustrate a fixing device according to a second embodiment of the present invention. In the present embodiment, a silicone oil collecting member 71 shown in FIG. 4B is provided inside the cleaning web unit. The silicone oil collecting member 71 is disposed in a manner as to contact the cleaning web 54 immediately before the cleaning web 54 enters a cleaning nip part. The cleaning nip part is located at a pressure contact part between the cleaning web contact roller 51 and the pressure roller 22, where the cleaning web 54 is sandwiched.

Figure 5:
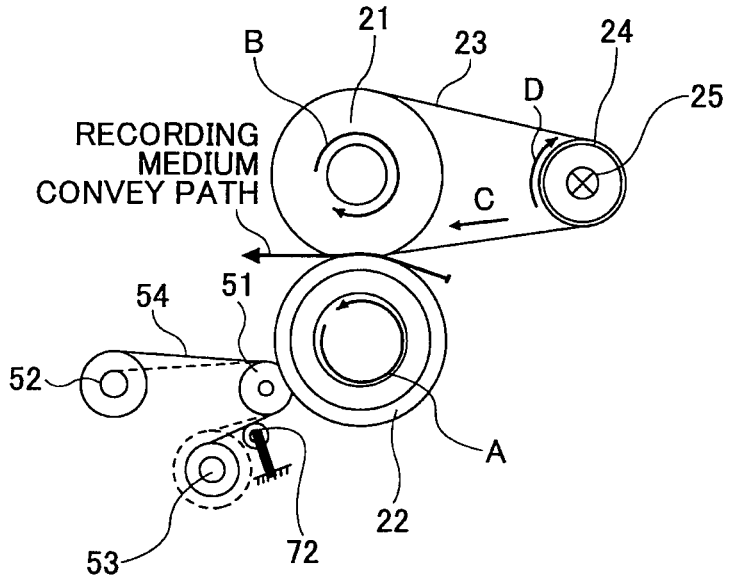
FIG. 5 illustrates an example of the shape of a silicone oil collecting member used in the fixing device according to the second embodiment of the present invention.

In the present embodiment, in the cleaning web unit, in an initial state before the cleaning web 54 is consumed (FIG. 4A), the silicone oil collecting member 71 is not in contact with the cleaning web 54. After a certain amount of the cleaning web 54 is consumed (FIG. 4B), the silicone oil collecting member 71 is brought in contact with the cleaning web 54. Thereafter, the silicone oil collecting member 71 continues to be in contact with the cleaning web 54 until the cleaning web 54 is completely consumed (FIG. 4C). The consumption amount of the cleaning web 54 at which the silicone oil collecting member 71 is brought in contact with the cleaning web 54 may be changed, by changing a support position of the silicone oil collecting member 71 with the use of a position adjusting means (not shown). The silicone oil collecting member 71 may be a roller-type rotating body like a silicone oil collecting member 72 shown in FIG. 5.

The silicone oil collecting members 71 and 72 may be made of a heat-resistant nonwoven cloth or a heat-resistant sponge that is resistant to heat of a higher temperature than the maximum temperature of the pressure roller 22 against which the cleaning web 54 is pressed by the cleaning web contact roller 51. Furthermore, by using felt having microscopic pores as the silicone oil collecting members 71 and 72, the silicone oil can be collected. Furthermore, by using a heat-resistant material as the silicone oil collecting members 71 and 72, the silicone oil collecting members 71 and 72 are prevented from degrading even when they are located near the heated fixing member, so that silicone oil can be stably collected.

Third Embodiment

Figure 6A:
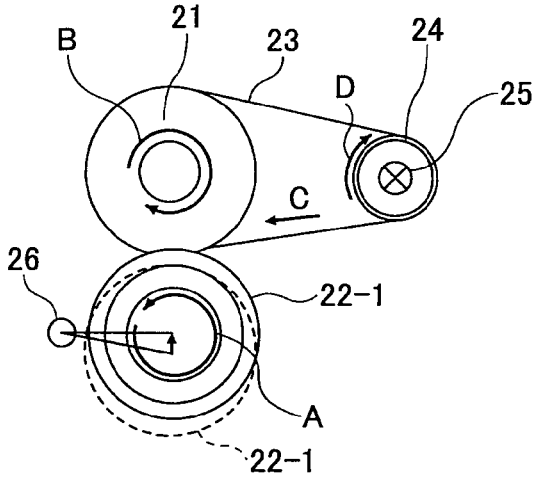
FIG. 6A illustrates a fixing device according to a third embodiment of the present invention.
Figure 6B:
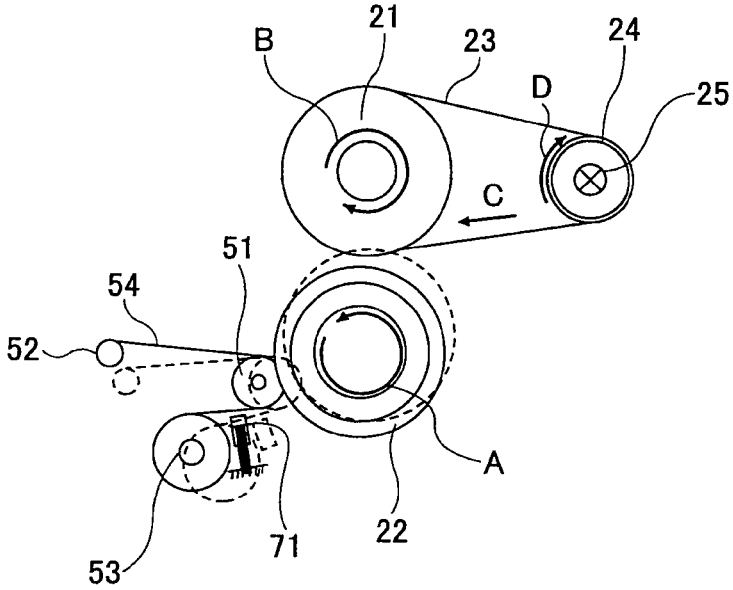
FIG. 6B illustrates the cleaning web unit moving between a state of applying pressure and a state of not applying pressure in the fixing device according to the third embodiment of the present invention.

FIGS. 6A and 6B illustrate a fixing device according to a third embodiment of the present invention. In the present embodiment, as shown in FIG. 6A, the pressure roller 22 performs operations of applying pressure and releasing pressure, by pivoting on a rotational center shaft 26. That is to say, as shown in FIG. 6A, the pressure roller 22 pivots on the rotational center shaft 26 by being driven by a driving means (not shown), so that the pressure roller 22 can be positioned in either a pressure reduction state 22-1 or a pressure application state 22-2. Furthermore, as shown in FIG. 6B, the cleaning web unit is moved in accordance with the pivoting and rolling movements of the pressure roller 22. The elements included in the cleaning web unit, i.e., the cleaning web roll-up roller 52, the cleaning web supply roller 53, the cleaning web contact roller 51, and the silicone oil collecting member 71, can constantly maintain predetermined positional relationships with the pressure roller 22, in an axial cross-sectional plane. Therefore, the cleaning web unit can stably implement the cleaning functions.

In the first embodiment described with reference to FIGS. 1A through 1D, the pressure roller can pivot on a rotational center shaft (not shown), and can be driven by a driving means (not shown) to be positioned in either a pressure application state or a pressure reduction state as in the third embodiment.

Fourth Embodiment

By providing an image forming apparatus with a fixing device having a heating device including the above described cleaning unit, an image forming apparatus having good fixing properties can be achieved.

According to one embodiment of the present invention, a heating device, a fixing device, and an image forming apparatus are provided, in which excessive silicone oil is prevented from being applied to a fixing member surface during a cleaning operation, so that uneven gloss and gloss streaks are prevented from being formed on the fixed image.

The present invention is not limited to the specific embodiments described herein, and variations and modifications may be made without departing from the scope of the present invention.

The present application is based on Japanese Priority Patent Application No. 2010-056810, filed on Mar. 12, 2010, the entire contents of which are hereby incorporated herein by reference.

What is claimed is:

1. A heating device comprising:

a fixing member;

a pressure member that comes in pressure contact with a surface of the fixing member; and a cleaning web unit including a contact roller that contacts the pressure member via a web that is impregnated with a lubricant agent, a supplying roller that supplies a new web, a roll-up roller that rolls up and retrieves the web that has been used for wiping off adhering matter from the pressure member, and a lubricant agent absorption member that absorbs the lubricant agent by contacting the web at a web path extending from the supplying roller to the contact roller, wherein a top surface of the lubricant agent absorption member that faces the web is spaced apart from and does not contact the web when the web that is impregnated with the lubricant agent, is initially supplied from the supplying roller, wherein the top surface of the lubricant agent absorption member is no longer spaced apart from the web and is configured to contact the web at the web path when a consumption amount of the web reaches a predetermined amount, and wherein the lubricant agent absorption member is positioned to contact the web immediately before the web enters a cleaning nip part.

2. The heating device according to claim 1, wherein the lubricant agent absorption member has heat resistance for resisting heat of a temperature greater than or equal to a maximum temperature of the pressure roller with which the web is brought into contact, and the lubricant agent absorption member includes a microscopic pore structure provided inside the lubricant agent absorption member.

3. The heating device according to claim 1, wherein the cleaning web unit contacts the pressure member that performs a pressure application operation and a pressure reduction operation, and a position of the cleaning web unit is changed in accordance with the pressure application operation and the pressure reduction operation.

4. The heating device according to claim 1, wherein the lubricant agent is silicone oil.

5. A fixing device including the heating device according to claim 1.

6. An image forming apparatus including the fixing device according to claim 5.

7. A heating device comprising:

a fixing belt that is an endless belt wound around plural rollers or sliding members, the fixing belt being caused to move around the plural rollers or sliding members;

a pressure member that comes in pressure contact with a surface of the fixing belt, so that a toner layer resting on a recording medium is fixed to the recording medium by heat and pressure when the recording medium passes through a nip part between the fixing belt and the pressure member, the fixing belt having a higher toner releasability than the pressure member;

a mechanism that changes a position where the pressure member contacts the fixing belt so that the nip part becomes present or absent and a width of the nip part is adjusted; and a web cleaning unit including a contact roller that contacts the pressure member via a web that is impregnated with a lubricant agent, a supplying roller that supplies a new web, a roll-up roller that rolls up and retrieves the web that has been used for wiping off adhering matter from the pressure member, and a lubricant agent absorption member that absorbs the lubricant agent by contacting the web at a web path extending from the supplying roller to the contact roller, wherein a top surface of the lubricant agent absorption member that faces the web is spaced apart from and does not contact the web when the web that is impregnated with the lubricant agent, is initially supplied from the supplying roller, wherein the top surface of the lubricant agent absorption member is no longer spaced apart from the web and is configured to contact the web at the web path when a consumption amount of the web reaches a predetermined amount, and wherein the lubricant agent absorption member is positioned to contact the web immediately before the web enters a cleaning nip part.

8. The heating device according to claim 7, wherein the lubricant agent is silicone oil.

9. A fixing device including the heating device according to claim 7.

10. An image forming apparatus including the fixing device according to claim 9.

11. The heating device according to claim 1, wherein the consumption amount of the web at which the lubricant agent absorption member is brought in contact with the web is configured to be changed by changing a support position of the lubricant agent absorption member.

12. The heating device according to claim 7, wherein the consumption amount of the web at which the lubricant agent absorption member is brought in contact with the web is configured to be changed by changing a support position of the lubricant agent absorption member.

13. The heating device according to claim 1, wherein the top surface of the lubricant agent absorption member is configured to contact the web at the web path from when the consumption amount of the web reaches the predetermined amount until the web is completely consumed.

14. The heating device according to claim 7, wherein the top surface of the lubricant agent absorption member is configured to contact the web at the web path from when the consumption amount of the web reaches the predetermined amount until the web is completely consumed.

* * * * *